US007514876B2

(12) United States Patent
Roach, Jr.

(10) Patent No.: US 7,514,876 B2
(45) Date of Patent: Apr. 7, 2009

(54) POWER SOURCE MOUNTED TO A FLUORESCENT LIGHT

(75) Inventor: Peter O. Roach, Jr., Atlanta, GA (US)

(73) Assignee: NxSteps Communications, Atlanta, GA (US)

( * ) Notice: Subject to any disclaimer, the term of this patent is extended or adjusted under 35 U.S.C. 154(b) by 128 days.

(21) Appl. No.: 11/195,480

(22) Filed: Aug. 2, 2005

(65) Prior Publication Data

US 2005/0264220 A1 Dec. 1, 2005

Related U.S. Application Data

(62) Division of application No. 10/790,644, filed on May 21, 2004, now Pat. No. 7,247,994.

(60) Provisional application No. 60/472,393, filed on May 22, 2003, provisional application No. 60/513,720, filed on Oct. 24, 2003, provisional application No. 60/518,506, filed on Nov. 7, 2003.

(51) Int. Cl.
*H05B 37/02* (2006.01)

(52) U.S. Cl. ..... 315/155; 315/158; 362/183; 362/184

(58) Field of Classification Search ..... 315/149, 315/155, 158, 160, 291; 362/183, 184, 228, 362/221, 230, 234
See application file for complete search history.

(56) References Cited

U.S. PATENT DOCUMENTS

| | | | | |
|---|---|---|---|---|
| 23,335 A | | 3/1859 | Oyamada et al. | 362/220 |
| 30,367 A | | 10/1860 | Belokin, Jr. | 362/184 |
| 4,100,547 A | | 7/1978 | Cooke | 362/185 |
| 4,114,299 A | | 9/1978 | Brownlee | 362/184 |
| 4,858,087 A | | 8/1989 | Hartshorn | 362/219 |
| 4,978,890 A | | 12/1990 | Sekiguchi et al. | 362/219 |
| 5,278,536 A | * | 1/1994 | Furtaw et al. | 398/127 |
| 5,424,859 A | | 6/1995 | Uehara | 398/127 |
| 5,548,494 A | * | 8/1996 | Blackman | 362/183 |
| 5,612,593 A | | 3/1997 | Olson | 315/117 |
| 5,716,128 A | | 2/1998 | Clark et al. | 362/221 |
| 5,806,760 A | | 9/1998 | Maiello | 362/221 |
| 5,822,361 A | | 10/1998 | Nakamura et al. | 362/219 |
| 5,926,301 A | | 7/1999 | Hirt | 362/182 |
| 6,005,884 A | | 12/1999 | Cook et al. | 375/132 |

(Continued)

FOREIGN PATENT DOCUMENTS

WO WO 02/03761 A1 * 1/2002

*Primary Examiner*—Douglas W Owens
*Assistant Examiner*—Jimmy T Vu
(74) *Attorney, Agent, or Firm*—King & Spalding

(57) ABSTRACT

The invention provides a power source that can be configured for being mounted to a fluorescent light. The internal electronics of the power source are contained within a housing. Attachment means are used to attach the housing to a fluorescent lamp. The attachment means may comprise a support tube attached to the housing. The support tube fits over the fluorescent lamp and attaches to the housing to secure the power source to the fluorescent lamp. Alternatively, the housing may include power coupling pins on one side and fluorescent lamp pin connectors on the opposite side. The power coupling pins fit into one receptacle of the fluorescent light fixture and the pins of the fluorescent lamp are inserted into the fluorescent lamp pin connectors of the housing such that the power source is mounted between the fluorescent lamp and the fluorescent light fixture.

9 Claims, 4 Drawing Sheets

U.S. PATENT DOCUMENTS

| | | | | |
|---|---|---|---|---|
| 6,036,334 | A * | 3/2000 | Nakano | 362/234 |
| 6,222,503 | B1 | 4/2001 | Gietema et al. | 343/890 |
| 6,400,968 | B1 | 6/2002 | White et al. | 455/572 |
| 6,472,824 | B2 | 10/2002 | Hsiao | 362/221 |
| 6,492,897 | B1 | 12/2002 | Mowery, Jr. | 398/127 |
| 6,539,028 | B1 | 3/2003 | Soh et al. | 315/219 |
| 6,587,479 | B1 | 7/2003 | Bianchi et al. | 315/209 R |
| 6,758,697 | B1 | 7/2004 | Wu | 455/572 |
| 2003/0214399 | A1 | 11/2003 | Naruse et al. | 315/219 |
| 2004/0061454 | A1 | 4/2004 | Prasad | 375/132 |
| 2004/0192227 | A1 * | 9/2004 | Beach et al. | 455/90.3 |
| 2005/0017656 | A1 | 1/2005 | Takahashi et al. | 315/117 |
| 2005/0231128 | A1 | 10/2005 | Franklin | 375/127 |

* cited by examiner

POWER SOURCE MOUNTED TO A FLUORESCENT LIGHT

RELATED APPLICATIONS

The present application is a divisional of U.S. Non-Provisional patent application Ser. No. 10/790,644 entitled "Methods and Apparatuses for Mounting a Wireless Network Component to a Fluorescent Light," filed May 21, 2004, now U.S. Pat. No. 7,247,994 which claims the benefit of the following three provisional patent applications, each of which are incorporated herein by reference: (i) U.S. Provisional Patent Application Ser. No. 60/472,393 entitled "Methods and Apparatus for Attaching a Wireless Network Device to a Lighting Fixture to Derive a Power Source and a Mounting Fixture," filed May 22, 2003; (ii) U.S. Provisional Patent Application Ser. No. 60/513,720 entitled "Methods and Apparatus for Attaching a Network Device to a Fluorescent Lamp to Derive Power," filed Oct. 24, 2003; and (iii) U.S. Provisional Patent Application Ser. No. 60/518,506 entitled "Methods and Apparatus for Mounting a Wireless Device by Means of Attaching or Securing to a Fluorescent Lamp," filed Nov. 7, 2003.

TECHNICAL FIELD

The present invention relates generally to wireless networks and more particularly to the installation of wireless network components in a dwelling, commercial building, industrial facility, campus environment, enterprise space, tunnel, parking garage and other locations where gaps in wireless signal coverage may be prevalent or an increase in network capacity may be desirable.

BACKGROUND OF THE INVENTION

The term "wireless network" is used herein to refer to any network to which a wireless computing device or a wireless communications device can connect through wireless means. A wireless connection is commonly achieved using electromagnetic waves, such as radio frequency ("RF") waves, to carry a signal over part or all of the communication path. Wireless networks can be private or public in nature and can be designed for two-way communications or for one-way broadcasts. Examples of wireless networks are 802.11, Bluetooth, HyperLAN, Ultra Wideband Radio, and Radio Frequency Identification (RFID). As wireless computing devices and wireless communications devices become more and more prolific, the demand increases for more ubiquitous access to these wireless networks.

Private wireless networks often serve a single building, campus or other defined location. To meet current government regulations for use of the radio frequency spectrum, a low signal transmit level is often used in these types of environments. This low transmit level allows the wireless signal to be effectively limited to the desired area by using walls, furniture, other obstructions in the environment, or even free space to attenuate and contain the signal. While a low transmit level works well to contain the wireless signal, it can also have the unintended consequence of allowing undesired gaps in the coverage area, for example by: (i) limiting the effective range of a wireless signal; amplifying or magnifying the impact of obstructions in the environment; reducing the amount of reflection of the wireless signal; and/or reducing the amount of wireless signal penetration through walls, windows, structures, or obstructions.

Wireless signal coverage gaps are also common in public networks. For example, two way communications networks, such as, cellular networks, PCS networks, paging networks, and mobile data networks, are often characterized by gaps in wireless signal coverage in areas such as tunnels, building lobbies, public gathering spaces, airports, public arenas, convention facilities, office spaces, etc. As another example, one way broadcast networks, such as satellite radio networks, GPS networks, or even AM radio stations, also tend to include wireless signal coverage gaps in areas such as buildings, public arenas, tunnels, or even under highway overpasses.

To provide wireless signal coverage within the gaps of a wireless network or to add traffic carrying capacity, additional network equipment is usually required. A common method of covering a gap or adding capacity is to place an additional network access point, such as a base station, in a location where it can communicate with one or more wireless computing device or wireless communications device located in or near the gap. A network access point may or may not require a dedicated hard-wired communications facility to or from the hardwired network. Adding network access points to a wireless network can allow additional communication channels to be added to the wireless network and usually allows additional traffic carrying capacity to be added as well. Both wired and wirelessly interconnected network access points are well known in the art.

In locations where additional channels or traffic carrying capacity is not needed on the wireless network, a wireless repeater, wireless reradiator, or wireless signal booster can be used to cover a gap. Usually a wireless repeater, wireless reradiator, or wireless signal booster receives the wireless signal over the air and then repeats the wireless signal or regenerates the wireless signal on either the same channel or another wireless channel. Wireless repeaters, wireless reradiators, and wireless signal booster are well known in the art. The benefits of using a wireless repeater, wireless reradiator, or wireless signal booster instead of a network access point can be a reduction in cost, size, power consumption and/or the lack of a need for a back-haul communications facility to the network.

Hereinafter, network access points, wireless repeaters, wireless reradiators, wireless signal boosters and other wireless network devices, such as hubs, routers gateways, etc. are referred to collectively as "wireless network components." It is known that wireless signal coverage is, in many cases, maximized by locating a wireless network component as high as possible in the environment. This allows line of sight from the wireless network component to more of the area without encountering obstructions such as desks, filing cabinets, office equipment, inventory, or other items commonly found in a commercial building, office space, retail space, manufacturing space, etc. The optimal location for a wireless network component, for purposes of maximizing wireless signal coverage, may thus be an overhead location, such as a ceiling.

Unfortunately, mounting a wireless network component to a ceiling may be difficult, require special mountings or specialized skills, or may require the device to be camouflaged from view. For example, it can be difficult or cost prohibitive to mount equipment to poured concrete ceilings, which are common in many buildings concrete. As another example, hotels and professional offices typically will not wish to have excess equipment mounted where it is obvious to their guests. Also, the overhead space of some manufacturing plants and other environment is characterized by an open plenum that would require specialized mounting brackets to suspend equipment from ceiling supports without obstruction from pipes, HVAC systems, etc. The cost of camouflaging a wireless network component and/or installing special mounting configurations would contribute to the overall cost of deployment and could make the overall cost of installation prohibitive. The need to remove mounting configurations and/or restore the overhead space to its pre-installation condition when a wireless network component is relocated could also be prohibitively cost and labor intensive.

Accordingly, there is a need to overcome the limitations of the prior art by adapting a wireless network component to be able to be easily mounted to existing infrastructure that is commonly available in many overhead locations. Beyond the need for ease of installation, wireless network components should also be easily relocated, so as to allow a network administrator to easily extend or reconfigure the coverage pattern of the wireless network.

SUMMARY OF THE INVENTION

The present invention satisfies the above-described needs by providing a wireless network component configured for being mounted to a fluorescent light. The internal electronics of the wireless network component are contained within a housing. Attachment means are used for attaching the housing to a fluorescent lamp that is or can be installed within a fluorescent light fixture. The attachment means may comprise a support tube that is configured to be attached to at least a portion of the housing. The support tube may be designed to fit over the fluorescent lamp and attach to the housing, such that the wireless network component housing is secured to the fluorescent lamp.

The housing may be suspended below, or otherwise positioned above or to one side of, the fluorescent lamp when the fluorescent lamp is installed within the fluorescent light fixture. The support tube may include joints, such as dove tail joints, that are designed to fit within corresponding grooves on the housing, or vice versa. At least a portion of the support tube may be translucent or transparent to allow light to pass through. The support tube may be designed to dissipate heat generated by the fluorescent lamp, such as by way of vents, a fan system or other heat sync method.

The support tube used to mount the wireless network component to a fluorescent lamp may be generally semi-cylindrical in shape or generally cylindrical in shape. If the support tube is generally cylindrical in shape, it may be configured to be opened to insert the fluorescent lamp therein. The housing of the wireless network component may include a recess channel for receiving the fluorescent lamp. The housing may also include a window in one or more of its sides to allow light emitted by the fluorescent lamp to pass through the housing.

In accordance with other aspects of the invention, a wireless network component may be configured for being mounted between a fluorescent lamp and a fluorescent light fixture. Power coupling pins may protrude from one side of the housing that contains the internal electronics of the wireless network component. The power coupling pins may be configured to be inserted into a receptacle within the fluorescent light fixture that would otherwise receive the pins of the fluorescent lamp. Fluorescent lamp pin connectors may be located on the opposite side of the housing and may be configured to receive the pins of the fluorescent lamp, such that the wireless network component is mounted between the fluorescent lamp and the fluorescent light fixture. The power coupling pins and the fluorescent lamp pin connectors may be electrically connected to each other, such as via a power converter, to complete a circuit that draws power from the power source of the fluorescent light.

The power coupling pins and the fluorescent lamp pin connectors may be vertically or horizontally offset from each other, such that the fluorescent lamp is installed at an angle relative to its intended axis within the fluorescent light fixture. The housing may include a recess channel for receiving the fluorescent lamp, so that the wireless network component fits more snugly within the fluorescent light fixture. At least a portion of the housing of the wireless network component may be translucent or transparent so that light from the fluorescent lamp can pass through the housing. The housing may also include means for dissipating heat generated by the fluorescent light.

In other embodiments, the wireless network component may be replaced by a power source (also referred to herein as a power converter device) configured for being mounted to a fluorescent light as described above. The power source may include an external plug, socket or other power port, to which an external device (e.g., a wireless network component or any other electronic device) may be electrically connected. Additional aspects, features and advantages of the invention will become apparent to those skilled in the art upon consideration of the following detailed description of illustrated embodiments exemplifying the best mode of carrying out the invention as presently perceived.

DETAILED DESCRIPTION OF EXEMPLARY EMBODIMENTS

Figure 1:
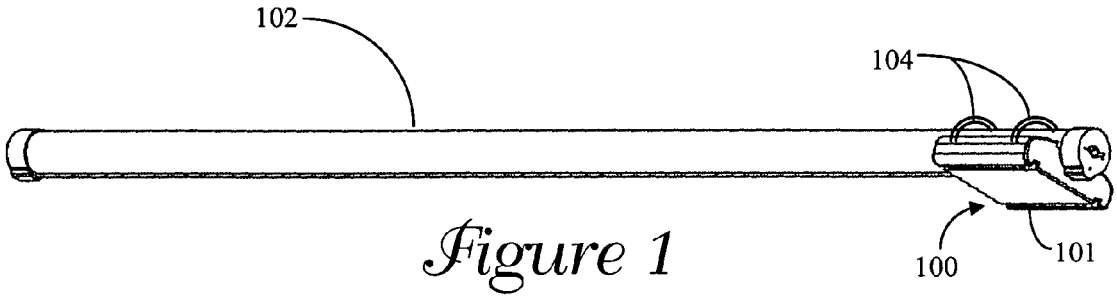
FIG. 1 is a perspective side-view illustration of an inventive wireless network component mounted to a fluorescent lamp, in accordance with certain exemplary embodiments of the present invention.

The present invention provides methods and apparatuses for mounting a wireless network component (or any other device) to an overhead light, which is one of the most commonly found overhead elements in business facilities, airports, commercial and industrial buildings and other locations where wireless network coverage is more likely to be needed. In certain exemplary embodiments, the wireless network component is mounted to a fluorescent lamp or other similarly shaped light bulb. Often the labor and costs involved in installing a wireless data network can cause the overall cost of the deployment to be prohibitive for many applications. With the ability to mount a wireless network component to a florescent lamp, the network administrator will be able to avoid much of the cost and trouble involved in the installation process. By using a florescent lamp as a mounting fixture for a wireless network component, the present invention allows an installer with minimal tools and skills to quickly install the wireless network component.

This ease of installation enables a network administrator to easily expand wireless signal coverage by simply adding new wireless network components to the wireless network. Mounting a wireless network component onto an existing florescent lamp in accordance with the invention also allows the wireless network component to be easily relocated or moved. Since wireless coverage is often difficult to predict and because changes in the environment can adversely impact the coverage and quality of a wireless system, it is often desirable to change the location of a wireless network component from time to time. If the wireless network component is designed to be permanently mounted and is not easily relocated or moved, the network administrator may tend to sub-optimize the network coverage or capacity due to the expense and/or difficulty of making rapid reconfigurations.

As used herein, the term "fluorescent light" is intended to encompass the fluorescent light fixture and the fluorescent lamp (i.e., light bulb). The term "fluorescent light fixture" is used herein to mean the fixture housing, power supply, connectors, wires, reflectors and all other components mounted to the ceiling or other location. In certain embodiments, the present invention allows the wireless network component to be easily inserted into the fluorescent lighting fixture and suspended from the fluorescent lamp. The wireless network component does not interfere with normal operation of the fluorescent lamp. This allows the addition of wireless signal coverage to an area while not significantly reducing the amount of intended illumination to the area from the florescent lamp or impacting the proper operation of the fluorescent light.

The present invention presumes that the wireless network component is powered through the power source of a fluorescent light. Preferred methods and structures for powering a wireless network component from the power source of a fluorescent light are described in co-pending U.S. patent application Ser. No. 10/785,463, filed Feb. 24, 2004, which is co-owned by the present assignee and incorporated herein by reference in its entirety. However, other methods for powering an overhead mounted wireless network component are possible, including but not limited to the use of replaceable and/or rechargeable batteries or power cells, commercial power sources, and Power over Ethernet ("PoE"). It should therefore be appreciated that the present invention is not limited to any particular method, configuration or components for powering a wireless network component.

Referring now to the attached figures, in which like numerals represent like elements, certain exemplary embodiments of the present invention will hereafter be described. FIG. 1 is a perspective side-view illustration of an inventive wireless network component 100 mounted to a fluorescent lamp 102. The wireless network component 100 may be mounted to a fluorescent lamp 102 that is linear, U-bent, Circline, or of any other shape. The description herein assumes that the wireless network component 100 will be mounted to a fluorescent lamp 102 that has a cylindrical cross-section, but the present invention could be adapted for lamps and light bulbs of other cross-sectional shapes as well.

The housing 101 of the wireless network component 100 contains the internal electronics necessary for the wireless network component 100 to perform the functionality needed or desired on the wireless network. For example, the housing 101 may optionally contain the necessary equipment for power conversion, a heat shield, an RF shield, antenna structures, and any other equipment needed for operations of the wireless network component 100. The housing 101 illustrated in FIG. 1 is merely one envisioned implementation and is not intended to be a limitation of the present invention. One skilled in the art could envision how the housing 101 could be easily modified or adapted to another design, made more ascetic, optimized for antenna placement or designed to fit into a specific lighting fixture or to mount to a differently shape or type of lamp or light bulb.

As shown, the wireless network component 100 may be mounted to a fluorescent lamp 102 such that it is suspended below the fluorescent lamp 102. Suspending the wireless network component 100 below the fluorescent lamp 102 may be preferred when there is little free space above or to the side of the fluorescent lamp 102 within the light fixture. However, the housing 101 of the wireless network component 100 may in some embodiments be small enough to fit within a fluorescent light fixture when the fluorescent lamp 102 is installed therein. In such embodiments, the wireless network component 100 may be mounted above or on the side of the fluorescent lamp 102.

The wireless network component 100 may be attached to the fluorescent lamp 102 using straps, brackets, braces, hooks, spring clips, wire rings, loop fasteners, ties, pins and/or any other suitable attachment means 104. At least a portion of the attachment means 104 may be permanently attached to the housing 101 of the wireless network component 100. At least a portion of the attachment means 104 may be removably attached to the to the wireless network component 100, such as by way of snaps, Velcro, buttons, clips, clamps, screws, a semi-permanent adhesive or any other suitable removable fastener. In other embodiments, the attachment means 104 may itself be some type of permanent or semi-permanent adhesive. As shown in FIG. 1, the exemplary attachment means 104 may be configured to loop over the top of the fluorescent lamp 102 and attach to the top sides of the wireless network component 100. The attachment means 104 may be made from metal, rubber, plastic or any other material that is strong enough to support the weight of the wireless network component 100 and withstand the heat exerted by the fluorescent lamp 102 and its fixture.

Figure 2:
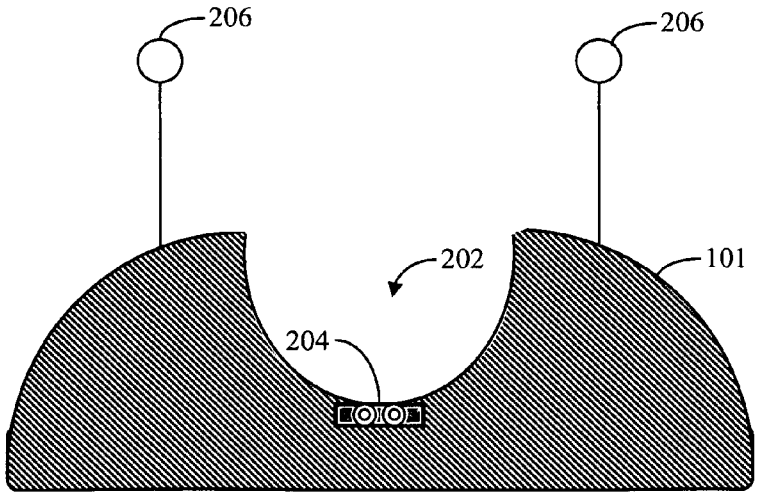
FIG. 2 is a front-view illustration of an exemplary wireless network component, in accordance with certain exemplary embodiments of the present invention.

FIG. 2 is a front-view illustration of an exemplary wireless network component 100. The housing 101 has a recess channel 202 for receiving the fluorescent lamp 102. As shown in FIG. 1, the fluorescent lamp rests in the recess channel 202 and may extend beyond the housing 101 of the wireless network component 100. The recess channel 202 allows the wireless network component 100 to fit more snugly against the fluorescent lamp 102, for space saving and aesthetic reasons. The shape of the recess channel 202 preferably corresponds generally to the cross-sectional shape of the fluorescent lamp 102. In the example shown, the recess channel 202 is semi-cylindrical in shape to correspond to a fluorescent lamp 102 having a cylindrical cross-section. However, the recess channel 202 does not necessarily need to correspond to the cross-section shape of the fluorescent lamp 102; other shapes will serve substantially the same purposes.

The housing 101 of the wireless network component 100 may be equipped with a power port 204 (e.g., an outlet, plug, socket or the like) for electrically connecting the wireless network component 100 to a power supply. As mentioned, the power supply used to power the wireless network component 100 may be the power supply of a fluorescent light, a commercial power line, PoE, or another available power source. In other embodiments, an alternative power supply, such as a replaceable and/or rechargeable battery may be contained within the housing 101 of the wireless network component 100. In certain of such embodiments, the power port 204 may be used to electrically connect the wireless network component 100 to an external power supply to recharge an internal rechargeable power supply and/or provide power to the wireless network component 100. Instead of a power port 204, the housing 101 may include an integrated power coupling that is designed to make electrical connection with the pins of a fluorescent lamp 102, the connectors (receptacles) within a fluorescent light fixture and/or any other portion of the circuit that supplies power to the fluorescent light.

In embodiments where power is drawn from the power supply of a fluorescent light, a major obstacle to overcome is the amount of noise that is thereby introduced to the power lines (e.g., circuits, power converter feeds, associated power cords, etc.) of the wireless network component 100. The present invention overcomes this obstacle by grounding at least one power line of the wireless network component 100 back to a metal surface within the fluorescent light fixture or to the ground source of the power supply of the fluorescent light. Grounding the wireless network component in this manner dampens the noise generated by the fluorescent light. The wireless network component 100 may include grounding components comprising a ground wire or other grounding means designed for temporary or permanent contact with the grounding source. Before making contact with the grounding source, the grounding means may be connected to a capacitor or similar component for avoiding coupling of significant amounts of electrical current.

Exemplary grounding means, ground wires 206, are shown in FIG. 2. The ground wires 206 are, in the preferred implementation, spring steel wires that extend beyond the housing 101 of the wireless network component 100 and are designed to touch the fluorescent light fixture when the wireless network component 100 is installed on a fluorescent lamp 102 therein. The exemplary ground wires 206 are not permanently affixed to the fluorescent light fixture, allowing for easy relocation of the wireless network component 100. Although two ground wires 206 are shown in the exemplary embodiment of FIG. 2, only one such ground wire needs to be electrically connected to the wireless network component 100 to achieve the grounding effect. The other ground wire may optionally be provided to provide symmetry and balance for the wireless network component 100 when mounted within the fluorescent light fixture. Other methods for grounding the wireless network component 100 will occur to those of ordinary skill in the art, including but not limited to use of a grounding screw wired to the wireless network component 100, use of a webbed mesh tether, use of a conductive bar, or use of other similar means.

Figure 3:
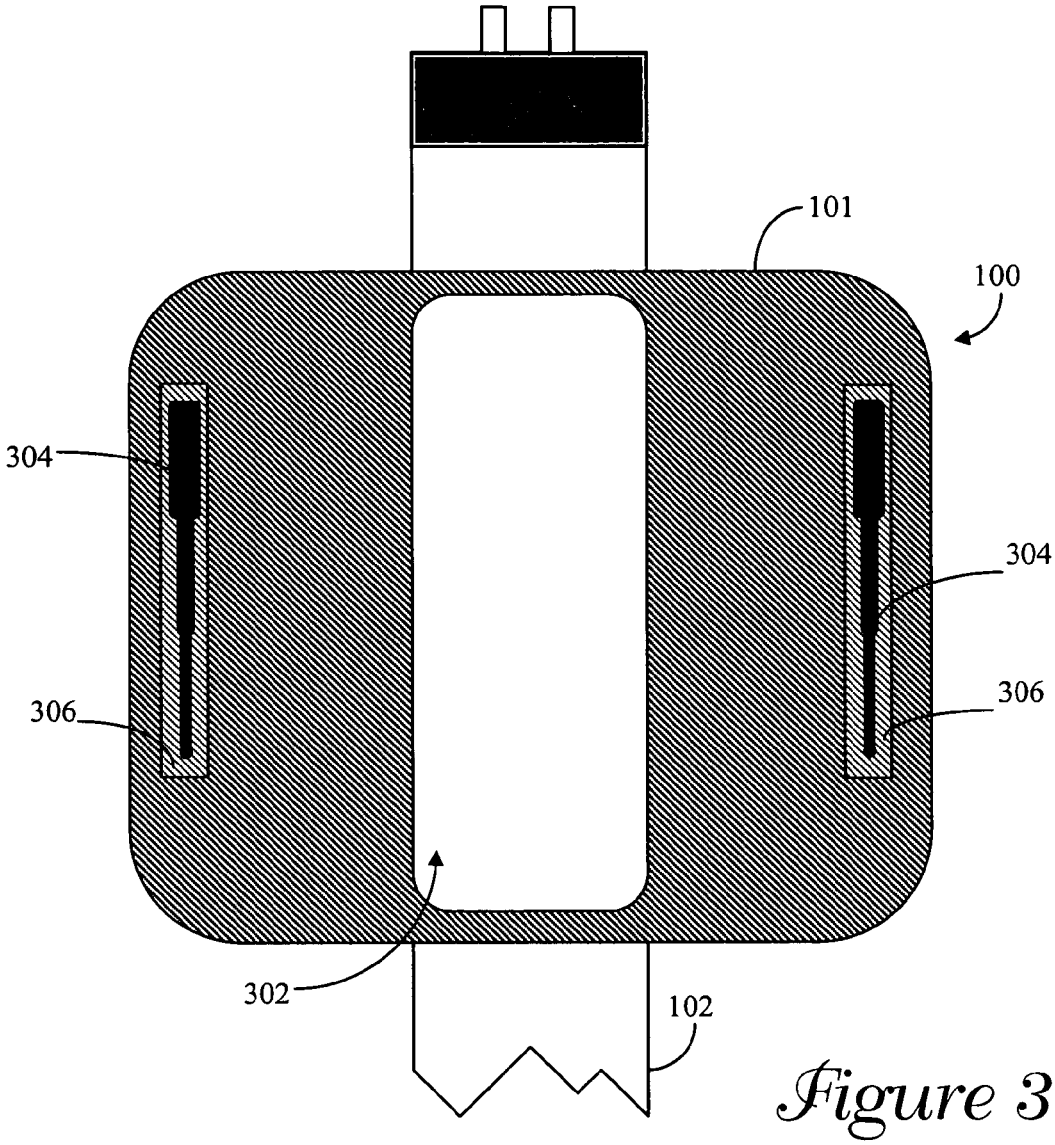
FIG. 3 is a bottom-view illustration of an exemplary wireless network component, in accordance with certain exemplary embodiments of the present invention.

FIG. 3 is a bottom-view illustration of an exemplary wireless network component 100. As shown, the bottom side of the housing 101 may include a window 302 or void that allows light from the fluorescent lamp 102 to pass through the housing 101. In such embodiments, the internal components are positioned to the sides of the window 302 within the housing 101, so as not to obstruct the path of the light. The window 302 may be of varying shapes and sizes. Obviously, a larger window 302 will allow more light from the fluorescent lamp 102 to pass through to the intended area. The window 302 may be covered with a translucent or transparent material to protect the internal component of the wireless network component 100. If the internal components of the wireless network component 100 are otherwise protected, the window 302 may be left open and uncovered. Depending on the configuration of the housing 101, one or more window 302 may be located on any one or more side thereof.

The housing of a florescent light fixture is typically constructed of metal. While a metal housing works well to dissipate heat and reflect light, it is not particularly conducive to transmitting RF energy. Thus, a metal fluorescent light fixture may tend to interfere with the operation of a wireless network component 100 mounted to a fluorescent lamp 102. Accordingly, certain embodiments of the present invention may provide one or more antenna 304 for the wireless network component 100. As shown in FIG. 3, exemplary antennae 304 may be attached to the bottom side of the housing 101 of the wireless network component 100 and may be retractable and/or foldable into a recess 306 in the housing 101 when not in use. Use of a retractable antenna 304 allows the antenna 304 to be extended to the appropriate length for maximizing wireless signal coverage of the wireless network component 100, while minimizing the impact to the existing light fixture.

In other embodiments, the one or more antenna 304 may be attached to a different part of the housing 101 of the other wireless network component 100. Alternatively, an antenna jack (not shown) may be provided on the housing 101 so that a removable antenna 304 can be mounted on or near the wireless network component 100 if necessary or desired. The antenna 304 could also be integrated into the housing 101 of the wireless network component 100 or into the florescent lamp 102 or light fixture. The antenna 304 may need to be configured so that it extends beyond or through any covering or lens of the fluorescent light.

Figure 4:
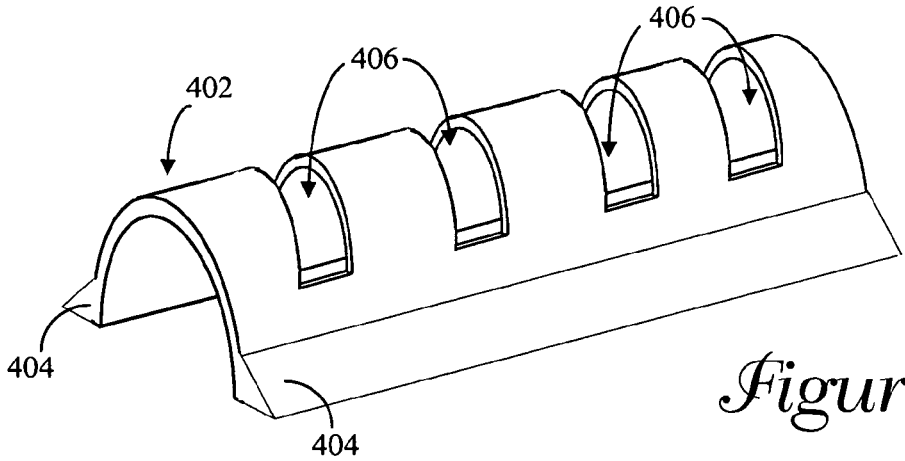
FIG. 4 is a side perspective view of a support tube that may serve as an attachment means for mounting a wireless network component to a fluorescent lamp, in accordance with certain exemplary embodiments of the present invention.

FIG. 4 is a side perspective view of a support tube 402 that may serve as an attachment means 104 for mounting a wireless network component 100 to a fluorescent lamp 102 in certain embodiments of the present invention. The support tube 402 preferably corresponds generally to the cross-sectional shape of the fluorescent lamp 102. In the example shown, the support tube 402 is generally semi-cylindrical in shape to correspond to a fluorescent lamp 102 having a cylindrical cross-section. However, the support tube 402 does not necessarily need to correspond to the cross-section shape of the fluorescent lamp 102; other shapes will serve substantially the same purposes.

In certain alternative embodiments, the support tube 402 may take the form of a full cylinder that is intended to be slid over the end of a fluorescent lamp 102. A full cylinder support tube 402 may work well with linear fluorescent lamps 102, but not with other fluorescent lamp form factors. For example, a U-bent florescent lamp 102 typically includes a brace or ground plane holding the straight ends of the fluorescent lamp 102 together. The brace or ground plate would prevent a full cylinder support tube 402 from being easily slid over one of the straight ends of the fluorescent lamp 102. Similarly, Circline fluorescent lamps 102 are typically in the shape of closed circle and thus cannot accept a full cylinder support tube 402. Of course, a full cylinder support tube 402 could be designed to open (e.g., using a hinged clamshell design) to accept non-linear fluorescent lamps 102.

Figure 5:
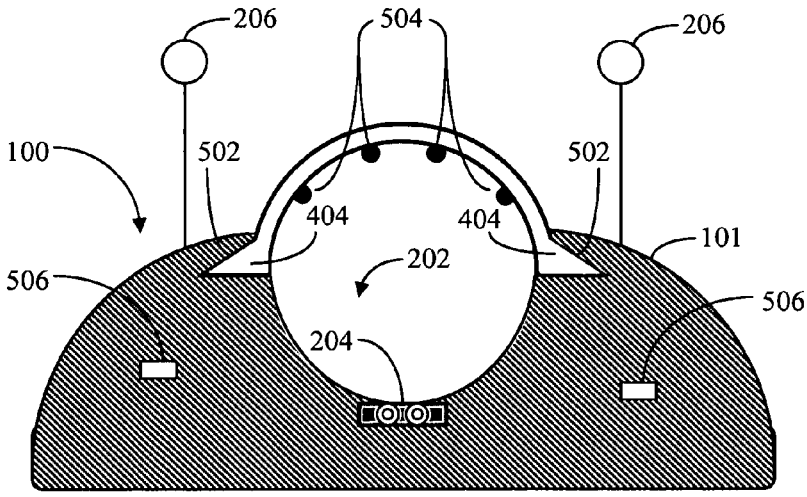
FIG. 5 is an illustration of the support tube of FIG. 4 attached to an exemplary wireless network component, in accordance with certain exemplary embodiments of the present invention.

Whether the support tube 402 is in the form of a cylinder, a semi-cylinder, or any other cross-sectional shape, it may be permanently or removably connected to the housing 101 of the wireless network component 100. In the exemplary embodiment shown in FIG. 4, the support tube 402 is generally semi-cylindrical in shape and is intended to be removably connected to the housing 101 of the wireless network component 100 via dove tail joints 404. The dove tail joints 404 fit into corresponding grooves 502 within the housing 101 of the wireless network component 100, as shown in FIG. 5. This use of dove tail joints 404 and corresponding grooves 502 allows the support tube 402 to be easily connected to and removed from the wireless network component 100.

In other embodiments, the support tube 402 may be connected to the wireless network component 100 using joint and corresponding grooves of other shapes. The joints may in some embodiments be provided on the housing 100 of the wireless network component 100 and the grooves may be provided on the support tube 402. Alternatively, the support tube 402 may be connected to the wireless network component 100 by other means, such as Velcro, snaps, pins, straps, brackets, braces, hooks, spring clips, wire rings, loop fasteners, ties, buttons, clips, clamps, screws, adhesive or any other suitable fastener. As another example, the support tube 402 may be hinged along one side to the wireless network component 100 and latched or otherwise removably attached to the other side of the wireless network component 100.

At least a portion of the support tube 402 may be made of transparent or translucent material, such as clear or semi-clear plastic or glass, to allow light from the fluorescent lamp 102 to pass through. For example, in cases where the support tube 402 is placed over the top of the fluorescent lamp 102, light from the fluorescent lamp 102 will pass through the transparent or translucent support tube 402 and reflect off of the reflector of the light fixture. The illumination from the uncovered portion of the fluorescent lamp 102, along with the reflection from the light fixture would reduce the amount of shadowing created by the wireless network component 100 suspended from the fluorescent lamp 102.

Generally, florescent lamps 102 are designed to achieve an optimal light output when operating in the range of twenty-five centigrade to thirty centigrade, i.e., seventy-seven degrees Fahrenheit to eighty-six degrees Fahrenheit. When a cover is placed over a portion of a high efficiency florescent lamp 102, the operating temperature of the fluorescent lamp 102 can exceed forty-nine centigrade, i.e., one hundred twenty degrees Fahrenheit. This rise in temperature can adversely impact the lumens output of the fluorescent lamp 102. Thus, when utilizing a support tube 402 or other attachment means 104 that may cover a portion of the florescent lamp 102, it may be necessary to vent the heat from the fluorescent lamp 102 to ensure proper operation of the fluorescent lamp 102.

The exemplary support tube 402 shown in FIG. 4 has a plurality of vents 406 cut into its top surface. The size, shape and number of the vents 406 may vary, so long as sufficient heat from the fluorescent lamp 102 can be vented. In other embodiments, venting may also or alternatively be accomplished using a fan system or other heat sync method. One skilled in the art will appreciate that similar results may be achieved by using other materials or methods commonly know in the art to allow the removal of heat. For example, the support tube 402 may be made from a "breathable" or porous material that allows heat to escape through its surface.

It may also be desirable to configure the support tube 402 with raised portions 504 on its inner surface. Raised portions 504 contact the fluorescent lamp 102 and provide free space between the fluorescent lamp and the inner surface of the support tube 402. Thus, raised portions 504 or other spaces may facilitate venting of heat through the vents 406. The raised portions can enable the support tube 402 to more firmly "grip" the fluorescent lamp 102. Those skilled in the art will appreciate that the size, shape or number of the raised portions 504 may vary. For example, the raised portions 504 may take the form of knobs or bumps that are spaced along the inner surface of the support tube 402 in a random or patterned manner. The raised portions 504 could also take the form of ribs that run parallel or perpendicular to the length of the support tube 402.

The housing 101 of the wireless network component 100 may be provided with any number of indicators 506. Indicators 506 may be used for indicating such things as the status of the wireless network component 100 (e.g., functional or non-functional, powered or un-powered, etc.) and/or wireless signal strength. Any well-known type of indicator 506 may be used in connection with the exemplary wireless network component 100, such light bulbs, light emitting diodes, etc. Other suitable indicators 506 will also occur to those of ordinary skill in the art.

Figure 6:
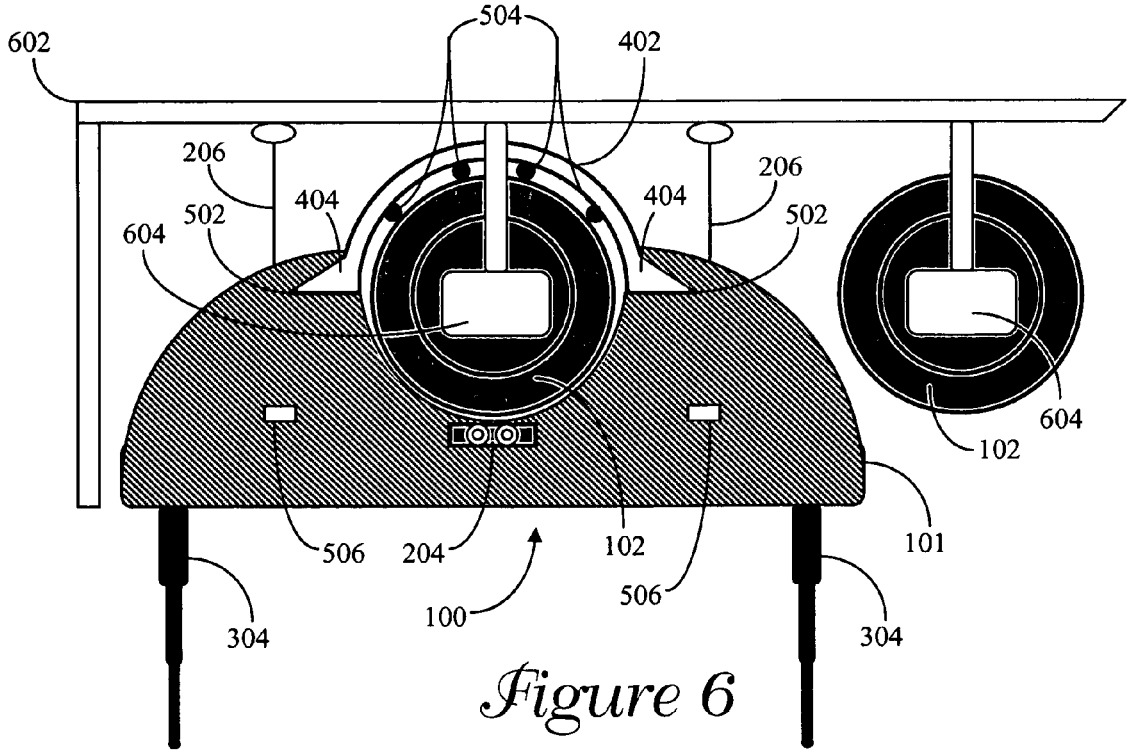
FIG. 6 is a front-view illustration of an exemplary wireless network component mounted to a fluorescent lamp that is installed into a fluorescent light fixture, in accordance with certain exemplary embodiments of the present invention.

FIG. 6 shows a front-view illustration of an exemplary wireless network component 100 mounted to a fluorescent lamp 102 that is installed into a fluorescent light fixture. The fluorescent lamp 102 is received by the receptacles 604 or other connector within the light fixture, such that the fluorescent lamp hangs slightly below the fixture housing 602. The exemplary support tube 402 (or other attachment means 104) fits over the fluorescent lamp 102 and connects to the housing 101 of the wireless network component 100, such as by way of dovetail joints 404 and corresponding grooves 502. In this manner the wireless network component 100 can be suspended below the fluorescent lamp 102.

The raised portions 504 of the support tube 402 contact the florescent lamp 102 and provide space between the fluorescent lamp and the support tube 402 to aid ventilation. The exemplary grounding wires 206, which may be spring steel wires, push up against a the light fixture housing 602 to ground any noise introduced to the power lines of the wireless network component 100 by the fluorescent light. One or more antenna 304 may extend below the light fixture housing 602. As stated previously, the shape and/or profile of the housing 101 may be such that it does not interfere with the installation of the fluorescent lamp 102 or any other fluorescent lamp 102 within the light fixture.

Figure 7:
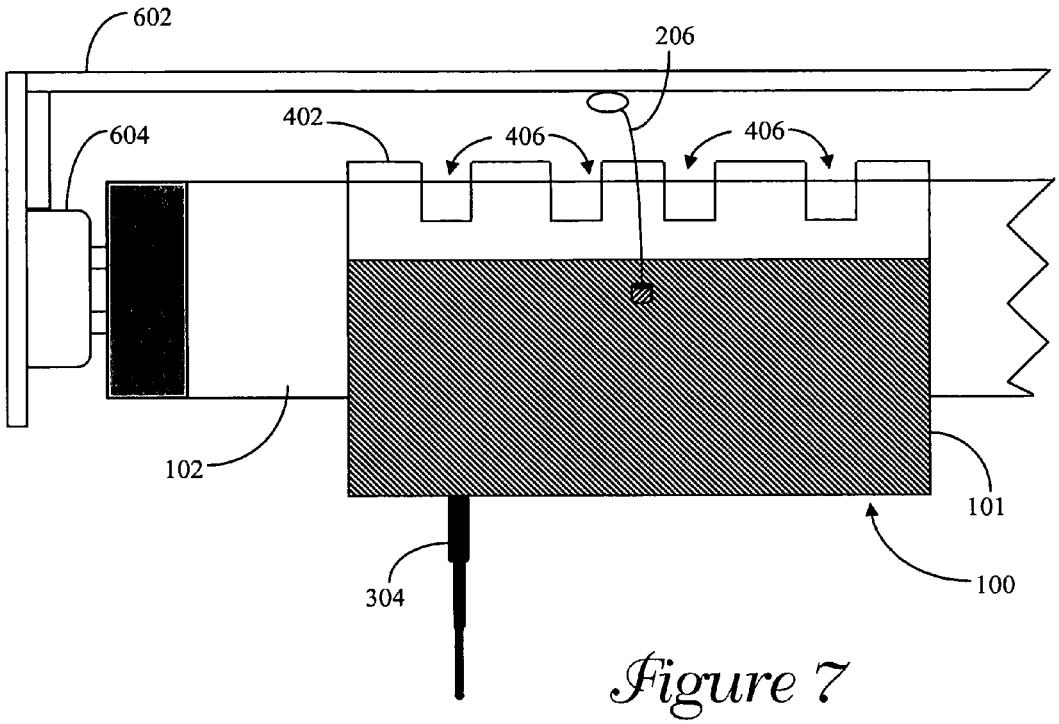
FIG. 7 is a side-view illustration of an exemplary wireless network component mounted to a fluorescent lamp that is installed within a fluorescent light fixture, in accordance with certain exemplary embodiments of the present invention.

FIG. 7 is a side-view illustration of an exemplary wireless network component 100 mounted to a fluorescent lamp 102, which is installed within a fluorescent light fixture. As again shown, the support tube 402 may fit over the fluorescent lamp 102 and the wireless network component 100 may be suspended below the fluorescent lamp 102. A series of vents 406 may be provided within the support tube 402 to vent the heat generated by the fluorescent lamp 102. The pins of the fluorescent lamp 102 are received by a receptacle 604 within the fluorescent light fixture housing 602.

While the above described embodiments relate mainly to mounting a wireless network component 100 to a florescent lamp 102, one skilled in the art will appreciate that the principles of the present invention can be extended to other styles of lamps, such as street lamps, incandescent lamps, security lights, low voltage lights, or virtually most all other type of standard or non-standard lamps. One skilled in the art will also appreciate how the attachment means 104 and/or the wireless network component 100 can be modified for mounting the wireless network component 100 to multiple lamps. The wireless network component 100 can also be mounted to one or more of the light fixture housing, the electrical connectors and the lens of the light fixture, alone or in combination with the lamp. Accordingly, while the described embodiments illustrate a wireless network component 100 mounted to a single florescent lamp, is the intention of the present invention to include other mounting options as well.

Figure 8:
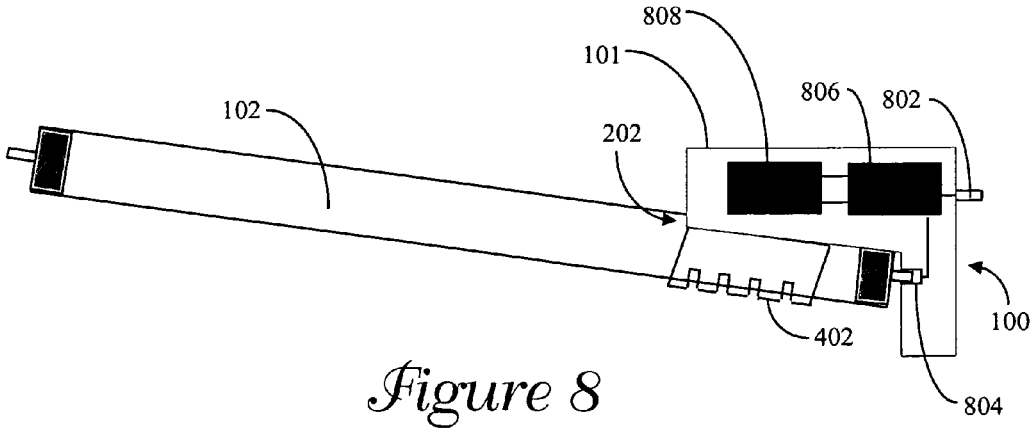
FIG. 8 is an illustration of an exemplary alternative embodiment of the present invention, in which a wireless network component is mounted between a fluorescent light fixture and a fluorescent lamp.

FIG. 8 is an illustration of another alternative embodiment of the present invention, in which a wireless network component 100 is mounted between the fluorescent light fixture and the fluorescent lamp 102. In this embodiment, the attachment means 104 takes the form of one or more power coupling pin 802 and one or more fluorescent lamp pin connector 804. The one or more power coupling pin 802 protrudes from one side of the housing 101 and the one or more fluorescent lamp pin connector 804 is positioned on the opposite side. The one or more power coupling pin 802 is inserted into the receptacle of a fluorescent light fixture that would otherwise receive the pin(s) of the fluorescent lamp 102. The one or more power coupling pin 802 makes electrical connection with the connectors within said receptacle and also supports the wireless network component 100 in its mounting position.

Additional supports, such as a brackets, fasteners or the like may also be used to support the wireless network component 100 in its mounting position if necessary or desired. Such additional supports may be used to permanently or temporarily attach the housing 101 of the wireless network component 100 to the fluorescent light fixture. As another option, a support tube 402 or any other suitable attachment means 104 may also be used to permanently or temporarily attach the housing 101 to the fluorescent lamp 102. However, the use of additional supports and/or a support tube 402 or other suitable attachment means 104 may not be necessary because the one or more power coupling pin 802 and the one or more fluorescent lamp pin connector 804 may be sufficient to support both the wireless network component 100 and the fluorescent lamp 102 in their mounting/installation positions.

The fluorescent lamp pin connector 804 is designed to receive and make electrical connection with the one or more pin of the fluorescent lamp 102. The one or more power coupling pin 802 and the fluorescent lamp pin connector 804 are electrically connected to each other, such as by way of a power converter 806, to complete a circuit that draws power from the power source of the fluorescent light. The fluorescent lamp pin connector 804 is preferably offset vertically (or horizontally) from the one or more power coupling pin 802. This offset allows the fluorescent lamp 102 to be installed at a slight angle relative to its intended axis within the fluorescent light fixture. Installation of the fluorescent lamp 102 at a slight angle creates additional space within the fluorescent light fixture in which the wireless network component 100 can be mounted.

A power converter 806 may be included to convert power from the fluorescent light into a voltage that can be utilized for powering the internal electronics 808 of the wireless network component 100. At the same time, the power converter 806 may allow sufficient power to pass to the fluorescent lamp 102 so that it can continue to provide at least a portion of the intended illumination. Those skilled in the art will appreciate that the shape of the wireless component 100 shown in FIG. 8 is illustrated by way of example only. Optionally, the exemplary housing 101 may contain a recess channel 202 to receive the fluorescent lamp, vents 406 or other heat dissipating means (not shown) and/or one or more windows 302 (not shown) for allowing light to pass. These and other configurations and designs are possible.

In addition, the internal electronics 808 and/or the power converter 806 of the wireless network component 100 could be housed in a separate housing mounted on or near the fluorescent light fixture. The circuit between the one or more power coupling pin 802 and the fluorescent lamp pin connector 804 may terminate in a plug, outlet or other power port. The separate housing and/or another external device could be electrically connected to such a power port by way of a power cord or the like.

In other embodiments, devices other than a wireless network component 100 may be mounted to a fluorescent lamp in accordance with the principles described above with reference to FIGS. 1-8. For example, it may be desirable to mount cameras, sensors, monitors, detectors, display screens, or any other electronic device to a fluorescent light. It is also envisioned that the mounted device may be a power converter device that makes electrical connection with the power supply of the fluorescent light. The power converter device may include an external plug, socket or other power port, to which an external device (e.g., a wireless network component 100 or any other electronic device) may be electrically connected. Alternatively, an empty housing 101 may in some embodiments be mounted to a fluorescent lamp 102 and configured for insertion of an off-the-shelf wireless network component 100 or other device. The empty housing 101 may include any necessary connectors, ports, etc. for connecting a wireless network component 100 or other device to a power supply, antenna or the like. Openings may also be provided in the empty housing 101 to allow exposure of any power lines, communications lines or antennae of the wireless network component 100 or other device.

Based on the foregoing, it can be seen that the present invention provides methods and apparatuses for mounting a wireless network component 100 or other device to an overhead light. Many other modifications, features and embodiments of the present invention will become evident to those of skill in the art. It should be appreciated, therefore, that many aspects of the present invention were described above by way of example only and are not intended as required or essential elements of the invention unless explicitly stated otherwise. Accordingly, it should be understood that the foregoing relates only to certain embodiments of the invention and that numerous changes may be made therein without departing from the spirit and scope of the invention as defined by the following claims. It should also be understood that the invention is not restricted to the illustrated embodiments and that various modifications can be made within the scope of the following claims.

What is claimed is:

1. A power source configured for being mounted to a fluorescent light comprising:

a housing containing a power port to which an external device may be electrically connected;

one or more power coupling pin protruding from one side of the housing and configured to be inserted into a receptacle within a fluorescent light fixture that would otherwise receive one or more pin of a fluorescent lamp; and one or more fluorescent lamp pin connector located on an opposite side of the housing and electrically connected to the one or more power coupling pin, wherein the one or more fluorescent lamp pin connector is configured to receive the one or more pin of the fluorescent lamp.

2. The power source of claim 1, wherein the one or more fluorescent lamp pin connector is electrically connected to the one or more power coupling pin via a power converter internal to the housing.

3. The power source of claim 2, wherein the power converter receives power from power source of the fluorescent light via the one or more power coupling pin; and wherein the power converter supplies the power to the internal electronics of the wireless network component and to the fluorescent lamp pin connector.

4. The power source of claim 1, wherein the one or more power coupling pin and the one or more fluorescent lamp pin connector are vertically offset relative to each other, such that the fluorescent lamp is installed at an angle relative to its intended axis within the fluorescent light fixture.

5. The power source of claim 1, wherein the one or more power coupling pin and the one or more fluorescent lamp pin connector are horizontally offset from each other, such that the fluorescent lamp is installed at an angle relative to its intended axis within the fluorescent light fixture.

6. The power source of claim 1, wherein at least a portion of the housing is at least partially transparent so that light from the fluorescent lamp can pass through the housing.

7. The power source of claim 1, wherein the housing includes means for dissipating heat generated by the fluorescent light.

8. The power source of claim 1, further comprising attachment means for attaching the housing to the fluorescent lamp.

9. The power source of claim 8, wherein the attachment means comprises a support tube configured to be attached to at least a portion of the housing; and wherein the support tube fits over the fluorescent lamp and attaches to the housing so as to attach the housing to the fluorescent lamp.

* * * * *